US007578073B2

(12) United States Patent
Krell et al.

(10) Patent No.: US 7,578,073 B2
(45) Date of Patent: Aug. 25, 2009

(54) APPLIANCE FOR REMOVING FLUIDS AND/OR SOLIDS

(75) Inventors: Lothar Krell, Erkerode (DE); Gerald Caspers, Meine (DE)

(73) Assignee: Braunschweigische Maschinenbauanstalt AG, Braunschweig (DE)

( * ) Notice: Subject to any disclaimer, the term of this patent is extended or adjusted under 35 U.S.C. 154(b) by 347 days.

(21) Appl. No.: 11/748,074

(22) Filed: May 14, 2007

(65) Prior Publication Data

US 2008/0189980 A1 Aug. 14, 2008

(30) Foreign Application Priority Data

Feb. 9, 2007 (EP) ..... 07002861

(51) Int. Cl.
*F26B 17/00* (2006.01)
*F26B 25/00* (2006.01)

(52) U.S. Cl. ..... 34/576; 34/586; 34/589; 34/168

(58) Field of Classification Search ..... 34/576, 34/586, 589, 58, 168, 169, 201, 209, 210
See application file for complete search history.

(56) References Cited

U.S. PATENT DOCUMENTS 3,292,350 A * 12/1966 Tasset ..... 34/58
4,444,129 A 4/1984 Ladt ..... 110/374
5,289,643 A 3/1994 Jensen ..... 34/169
6,154,979 A * 12/2000 Jensen ..... 34/363

FOREIGN PATENT DOCUMENTS

DE 299 24 384 U1 7/1999

(Continued)

OTHER PUBLICATIONS

A Search Report issued by the European Patent Office on Aug. 1, 2007, pp. 1 to 5.

*Primary Examiner*—Jiping Lu
(74) *Attorney, Agent, or Firm*—Whitham, Curtis, Christofferson & Cook, P.C.

(57) ABSTRACT

This invention relates to an appliance (1) for the removal of fluids and/or solids from a mixture of particulate materials with a container (2) that constitutes a ring-shaped processing space (20) with a cylindrical outer contour with devices for the charging and discharging of the particulate material into and out of the processing space (20) and with a fan device (5) for supplying a fluidization agent from underneath into the processing space (20) as well as devices (6) for the processing of the fluidization agent in the flow direction in front of the fan device, whereby in the processing space (20), cells (15, 16, 17) are formed extending in the vertical direction where one cell constitutes a discharge cell (17) through which there is no fluidization agent flow from underneath where at the lower end of the discharge cell the discharge device is arranged and where another cell (15) is provided with a charge device and where the cells (15, 16, 17) are open at their upper ends in order to facilitate transport of the material to the discharge cell (17), whereby above processing space (20), there adjoins twist scoops (9) that are inclined or curved in the flow direction from the charge cell (15) to the discharge cell (17), the outside diameter of which cells is not greater than the outside diameter of processing space (20) and that are surrounded by an outer jacket (3) that does not radially protrude over the outer jacket (3) of processing space (20).

27 Claims, 6 Drawing Sheets

FOREIGN PATENT DOCUMENTS

| | | | |
|---|---|---|---|
| DE | 299 24 384 | U1 | 2/2003 |
| DE | 699 23 771 | T2 | 7/2005 |
| EP | 0 153 704 | A2 | 2/1985 |
| EP | 0 955 511 | B1 | 9/2003 |
| WO | WO 92/01200 | | 1/1992 |
| WO | WO 92/01201 | | 1/1992 |

* cited by examiner

APPLIANCE FOR REMOVING FLUIDS AND/OR SOLIDS

This invention relates to an appliance for the removal of fluids and/or solids from a mixture of particulate materials with a container that constitutes a ring-shaped processing space with a cylindrical outer contour with devices for the charging and discharging of the particulate material into and out of the processing space and with a fan device for supplying a fluidization agent from underneath into the processing space as well as devices for the processing of the fluidization agent in the flow direction in front of the fan device, whereby in the processing space, cells are formed extending in the vertical direction through vertically extending walls where one cell constitutes a discharge cell through which there is no or a diminished fluidization agent flow from underneath where at the lower end of the discharge cell the discharge device is arranged and where another cell is provided with a charge device and forms a charge cell and where the cells are open at their upper ends. Such an appliance is particularly suitable for drying bulk goods and materials used in the food industry, although other particulate materials or mixtures thereof can also be treated with such an appliance.

The state of the art offers a plurality of appliances of the type mentioned, which, as a rule, employ superheated vapor as fluidization agent. These so-called fluidized-bed evaporation dryers are used in order to see to it that the bulk goods or particulate materials have superheated vapor flowing through them and so that they may be fluidized, thus generating a fluidized-bed layer. The material to be treated is charged from the charge cell in which the material to be treated is charged into the container and the processing space where it is conveyed via subsequent processing cells all the way to the discharge cell. There is no onflow from underneath in the discharge cell so that the treated material can be discharged at the lower end of the discharge cell, for example, through a discharge screw. On the discharge end as well as on the charge device, the container is sealed by means of a lock device so that the processing procedure can take place below overpressure. Such devices are known from U.S. Pat. No. 5,289,643, EP 0 955 511, DE 299 24 384 U1, EP 0 153 704 A1, EP 0 537 262 A1 and EP 0 537 263 A1.

Such an object is also known from DE 699 23 771 T2, which shows a typical process and a typical appliance. In the appliance according to DE 699 23 771 T2, the processing space is made up of a cylindrical outer skin in which there is likewise centrally arranged a cylindrical heat exchanger. Between the outer wall of the heat exchanger and the outer wall of the container, there are arranged vertically aligned partitions so that, starting from the charge cell, processing cells are arranged one behind the other in the flow direction and so that material passes through them until the material gets to the discharge cell whose bottom is closed or is not permeable to vapor. The lower end of the processing space is limited by an onflow tray through which the fluidizing agent is blown via a fan arranged below the heat exchanger into the processing space. Adjoining above the processing space is a conically widened transition area so as to reduce the flow speeds of the material, which is swept along upward, and to broaden the vapor stream. Conical sheet metal pieces, which can be heated, are inserted inside this conically widening transition area. These conical sheet metal pieces are used to intercept any particles driven by the vapor and to conduct them again downward. The conical transition area is subdivided in cells in a manner similar to the cells in the processing space.

Above the transition area, there is a common area that is not subdivided into cells. In the uppermost part of the system, there is a cyclone that extends around the heat exchanger and has a closed bottom. The dust particles are discharged out of the cyclone or they are connected with the discharge cell via a pipe. A number of cylindrical sheet metal pieces are suspended in the container around this cyclone; this cylindrical sheet metal pieces are used to guide the vapor when the latter flows to the openings inside the cyclone, whereby the sheet metal pieces with the exception of the area opposite the openings leading to the cyclone extend all the way to the top of the container. A stop sheet metal piece can be arranged radially between the cyclone and the outer wall of the container so that the vapor streams cannot move further around the cyclone but instead are guided in the direction of the openings in the cyclone.

Such systems have already been built in several cases and offer a high degree of efficiency regarding drying output as well as a relatively small energy consumption.

The object of this invention is to provide an improved appliance for the removal of fluids and/or solids with whose help one can achieve a greater drying output with a generally smaller investment volume for the entire appliance.

This problem is solved according to the invention by an appliance with the features given in the main claim. Advantageous embodiments and developments of the invention are given in the subclaims. The appliance for removing fluids and/or solids from a mixture of particulate materials with a container that constitutes a ring-shaped processing space with a cylindrical outer contour with devices for the charging and discharging of the particulate material into and out of the processing space and with a fan device for supplying a fluidization agent from underneath into the processing space as well as devices for the preparation of the fluidization agent in the flow direction in front of the fan device, whereby in the processing space, cells are formed that extend in the vertical direction through vertically extending walls where one cell forms a discharge cell through which there is no or a diminished fluidization agent flow from underneath where at the lower end of the discharge cell the discharge device is arranged and where another cell is provided with a charge device and forms a charge cell and where the cells are open at their upper ends, providing the following: Twist scoops are arranged above the walls and these scoops are inclined or curved in the flow direction from the charge cell to the discharge cell, the outside diameter of said scoops is not greater than the outside diameter of the walls and thus of the processing space, whereby the twist scoops are surrounded by an outer jacket, which does not radially protrude over the outer jacket of the processing space. The fluidization agent flows upward from underneath through the processing space, emerging between the twist scoops in the transition area that is above. As a result of the arrangement of twist scoops above the vertical walls, it is possible to influence and support the flow direction of the fluidization agent, especially superheated vapor, as well as the movement direction of the material to be treated. The twist scoops are so curved or inclined that in the free space arranged above, preferably without any flow-influencing assemblies, there is generated a rotating, homogeneous fluidization agent stream referred to as twist current. The centrifugal forces of this twist current move the particles that are swept along radially outward where they partly again fall downward into the area of the twist scoops or again fall into the processing space. The direction of the twist current prevents moist particles from directly getting out of the charge cell into the discharge cells.

The fluidization agent currents that fall out of the individual cells through the twist scoop area and subsequently enter the free space of the transition area reveal different quantitative currents and conditions of state that are homogenized in the twist current. A conical widening for the transition area and inserting likewise conically widening assemblies and baffle plates are no longer necessary so that, along with the space saving derived from at least the outer dimensioning in the axial direction, one can achieve a considerable material savings in the structure of the appliance.

It is possible to make the area above the twist scoops cylindrical or to have it taper conically upward in order to provide the most compact possible outer jacket and thus to have a structure that will use as little material as possible.

The cells that are formed by the vertical walls on whose upper end the twist scoops may adjoin can extend radially to the outer wall so that, looking in the circumferential direction, they represent a genuine subdivision and barrier. Passage openings can be present on the lower end of the walls so that the material, especially coarse particulate materials, can also continue on in the circumferential direction below the walls. The number of twist scoops essentially depends on the number of vertical walls, the arrangement of the twist scoops not being confined to the immediate association of the upper edge of the walls with the lower edge of the twist scoops.

The twist scoops can be attached on the walls or can be made together with them, something that facilitates continual control, both of the particulate materials and of the fluidization agent. As an alternative, there can be a vertical interval between the lower edges of the twist scoops and the upper edges of the walls, which interval possibly from the charge cell up to a place before the discharge cell but not from the discharge cell to the charge cell facilitates a free passage. The interval is used for uncoupling the walls from the twist scoops and for reducing the total weight of the appliance.

Above the free space, there a dust arrester is integrated on whose underside the fluidization agent flows in through the additional twist scoops. The additional twist scoops have the same orientation as the twist scoops and display a greater inclination or curvature in order to bring about an essentially circular flow movement, both of the fluidization agent as well as of the dust particles that are swept along by the fluidization agent and the particulate materials in the dust arrester. In other words, there is a two-stage deflection of the current or of the particle stream by the twist scoops and the additional twist scoops, as a result of which, a centrifugal field is generated in the dust arrester in which field the swept-along dust particles and the particulate materials preferably move outward and through at least one opening in the dust-arrester wall where they leave the dust arrester.

An embodiment of the invention provides the following: The pressure side of the twist scoops, related to the axial flow speed component of the fluidization agent, is inclined along the lower edge at an angle of up to 10°. On their lower edge, the twist scoops can also be oriented parallel to the axial component of the flow of fluidization agent and can incline or curve only then. A correspondingly curved or inclined attitude of the twist scoops at an angle of up to 10°, however, is also provided and possible.

On their upper edge, referring to their pressure side, the twist scoops are inclined toward the axial flow speed component at an angle of up to 35° in order to bring about a correspondingly intensive deflection, both of the flow of the fluidization agent and also of the particulate materials.

A superheater is arranged inside the container in the invention-based appliance; the inside diameter of the twist scoops corresponds to the outside diameter of the superheater. The twist scoops thus end radially inside with the superheater. The radially outer sides of the twist scoops extend all the way to the container wall, whereby on the radially outer side, there can also be a gap between the lateral edges of the twist scoops and of the container wall.

On their pressure side, the additional twist scoops are inclined toward the axial flow speed component of the fluidization agent at an angle of up 15° on the lower edge to bring about a more intensive deflection of the current. On their upper end, the inclination is as much as 90° in order almost completely to deflect the axial movement into the circumferential direction. The twist scoops and the additional twist scoops preferably are made up of sheet-metal-like material; therefore, the amount of the angle on the pressure side corresponds to the amount of the angle on the side facing away from the pressure side.

Above the additional twist scoops, return or return twist scoops are provided with an inclination or curvature pointing in the direction opposite to that of the twist scoops and the additional twist scoops; the pressure side of these return or return twist scoops with relation to the axial flow speed component of the fluidization agent at the charge end is inclined at an angle of up to 90°, whereby the inclination on the discharge end is inclined at an angle of up to 0° so that a current parallel to the axial direction is again materialized out of the ring-shaped current in the circumferential direction. As a result, the fluidization agent is deflected in the axial direction so that, preferably, there can be a return to the superheater and the fan.

In one embodiment of the invention, the fluid is evacuated via a centrally arranged discharge pipe, whereby the return scoops on their radially inner end adjoin the discharge pipe. The return scoops can have a doubly curved or doubly inclined shape, something that applies to the twist scoops and the additional twist scoops.

Besides, additional devices for purification, return as well as heating of the fluidization agent can be series connected before the fan in order to condition the fluidization agent.

An onflow tray with passage openings is arranged on the lower end of the processing space. This onflow tray can have devices to influence the volume flow so that, looking in the circumferential direction, in other words, in the direction in which the material to be treated is transported, one can set different fluidization agent volumes. The different fluidization agent volumes, for example, can be set as a function of the position of the cells. The heavier the material to be treated is, that is to say, the moister the material is, the greater should be set the volume of fluidization agent.

The cell with the charge device and the discharge cell can be arranged next to each other; a separation device is provided to prevent any direct transport from the charge cell to the discharge cell. When the charge cell and the discharge cell are arranged next to each other, the material must run through the entire circumference of the essentially ring-shaped processing space.

A development of the invention provides the following: The onflow tray is so shaped that the discharge of particles out of the processing space into the twist scoop area takes place by way of bursting bubbles of the fluidized particles corresponding to the separation conditions above the twist scoops, preferably radially outside near the container wall. To boost the eddy motion in the lower area of the processing space and on the radially outer edge of the processing space, in other words, in the area of the outer wall to set an increased flow speed so that the material will be conveyed upward there, the following is provided: On the radially outer area of the onflow tray, there is a greater opening ratio than on the radially inner area of the onflow tray. In other words, more or larger passage openings in the area of the outer wall are arranged in the onflow tray that in the area of the inner wall of the processing space, in other words, in the vicinity of the superheater.

The onflow tray has an arched shape to prevent particle deposits in the radially inner area of the processing space. The arching can be constant or it can be shaped by a number of essentially straight sheet metal pieces that are oriented at an angle with respect to each other. By virtue of the arching of the onflow tray in combination with the varied opening ratio of the onflow tray in the radial direction, one can generate a circulating fluidized-bed motion of the particles in the radial direction. The contours here must be seen in the plane of the vertical walls so that the onflow tray below the walls forms an arch or an arched polygonal segment. In contrast to that, in case of a level onflow tray, there is the danger of deposits of big particles that are difficult to fluidize.

The onflow tray can have passage openings for the fluidization agent, which can have different shapes. The passage openings, for example, can be made as holes, slits or other free passage surfaces. Likewise, the passage openings can be fashioned by gaps in the sheet metal pieces from which the onflow tray is made.

The most uniform possible fluidization state is provided in the cells to ensure particle transport. The properties of the particles in terms of fluidization technology change as a result of fluid removal from charge to discharge; therefore, in the area of the charge cell, there is arranged a larger opening ratio than in the area of the discharge cell. Preferably, the opening ratio declines from the charge cell to the discharge cell gradually or continually. The openings in the onflow tray can be arranged perpendicularly or at an angle thereto in order to influence the movement of the material inside the processing space.

An exemplary embodiment of the invention will be explained in greater detail below with reference to the attached figures.

Figure 1:
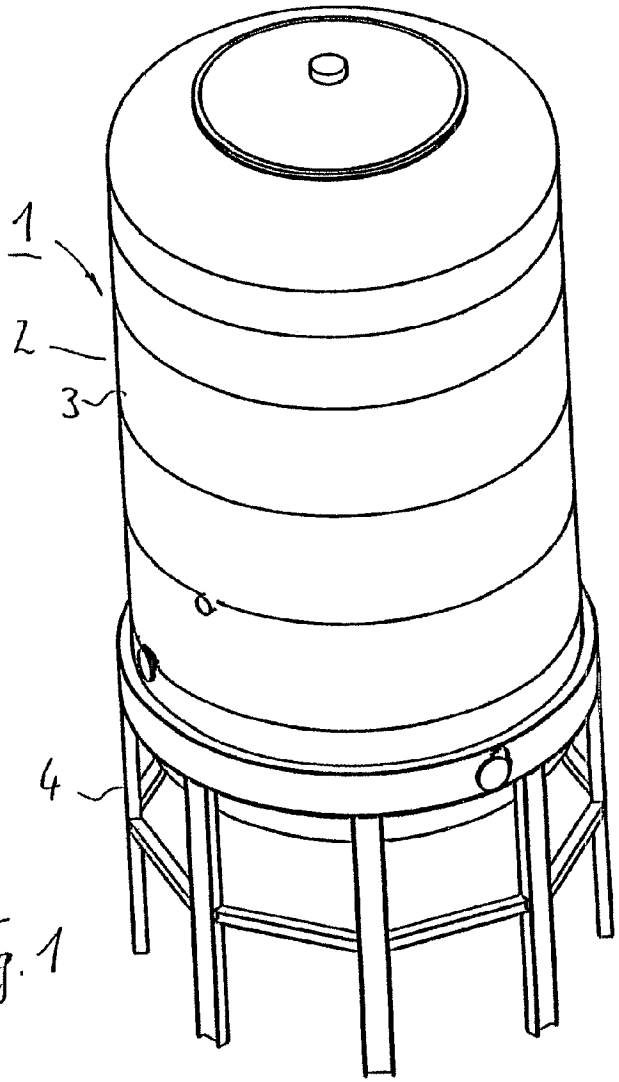
FIG. 1 is a perspective general view of an appliance.

FIG. 1 shows a perspective view of an appliance 1 with a container 2 that has an essentially cylindrical outer skin 3. Container 2 is positioned on a frame 4 in order to also make appliance 1 accessible to maintenance from underneath.

Figure 2:
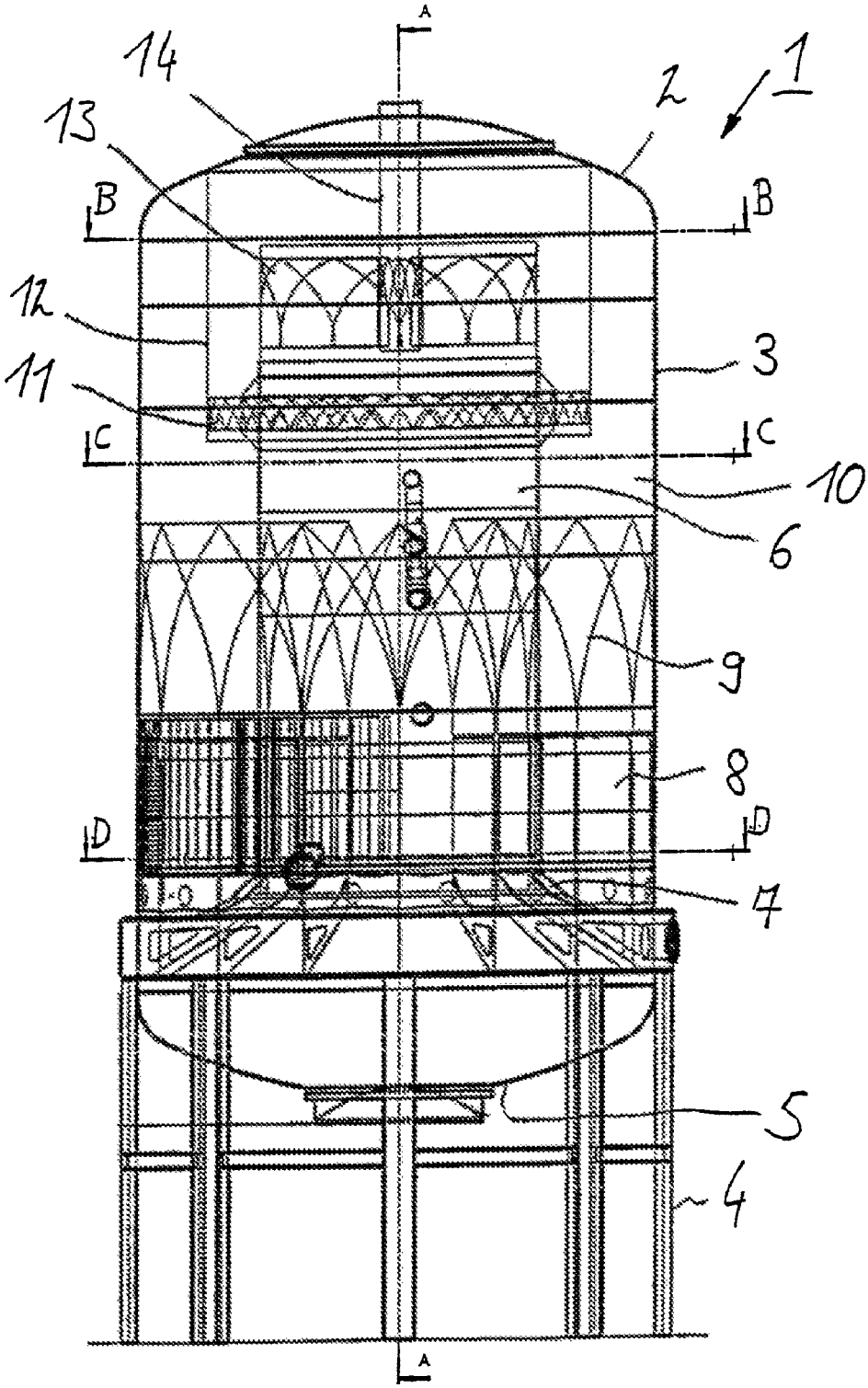
FIG. 2 is a partly cut-away side view of the appliance.

In FIG. 2, appliance 1 is shown with container 2 in a partly cut-away side view where the outer skin 3 was partly removed. One can see that the outer contour of container 2 is essentially cylindrical. The geometric structure of container 2 as well as the components arranged therein will be described below.

Container 2, standing on frame 4 at its lower end, has an arched bottom 5 in which is arranged a ventilator wheel, not shown, with which a fluidization agent, especially superheated vapor, is circulated in container 2. Inside container 2, there is arranged an essentially cylindrical superheater 6 so that the fluidization agent is fed into an essentially ring-shaped processing space 20 from underneath, which space is made between superheater 6 and outer skin 3. Processing space 20 here is limited along its lower end by an onflow tray 7 that permits passage of the fluidization agent from underneath but that does not allow the material to be treated from falling through.

Above onflow tray 7, there are arranged vertically aligned walls 8 that extend from the outer wall of superheater 6 all the way to container wall 3 and that form cells between themselves. Walls 8 can extend all the way down to onflow tray 7 or they can form a free space in between. The cells, formed by walls 8, are open on top so that the fluidization agent will flow through the cells from bottom to top and so that it will sweep the material to be treated or the particles along and possibly transport it into a subordinate cell. The cell, provided with a discharge device, not shown, does not have any fluidization agent flowing through it or has only a small amount of fluidization agent flowing through it so that, from above or along the onflow tray, material entering this cell will get into the bottom area and can be removed out of the discharge cell via the discharge device, for example, a screw conveyor.

Above walls 8 adjoin twist scoops 9 that can also be arranged between walls 8 and whose vertical extent roughly corresponds to the vertical extent of walls 8 or exceed said extent, in other words, they can be longer than walls 8. On their underside that faces toward walls 8, twist scoops 9 are essentially aligned parallel to walls 8 so that the pressure side of twist scoops 9 is oriented at an angle of 0° to the axial component of the flow speed of the fluidization agent. In the exemplary embodiment illustrated, twist scoops 9 are curved or are so oriented that the curvature points from the charge cell to the discharge cell. For example, if the charge cell and the discharge cell are arranged next to each other, then the curvature of the twist scoops 9 that are associated with the charge cell will point always from the discharge cell so that the stream of particles and material must be transported over the entire circumference of container 2 and thus of the processing space 20 in order to get all the way to the discharge cell.

At their upper end, twist scoops 9 have a curvature of up to 35° with respect to the axial component of the fluidization agent flow speed in order to deflect the stream of fluidization agent as well as that of the material into the circumferential direction. Twist scoops 9 represent a prolongation of walls 8, whereby this prolongation can be made with or without a gap between the twist scoops 9 and the walls 8. Twist scoops 9 can form a singly or doubly curved surface, in other words, they can have a curvature both around the axial component and around a radial component in order to deflect the stream of the fluidization agent and the movement direction of the material or the solids in accordance with requirements. Instead of a curvature, one can also provide for an inclination of the otherwise straight-wall twist scoops 9 to divert the flow direction.

Above twist scoops 9, there is a transition space 10 that is made as a free space, which is provided without any assemblies that might influence the flow so that the stream of the fluidization agent as well as the transport of the material and the particles swept along in the fluidization agent stream can take place essentially unhindered. This free space 10, the so-called transition area, is ring-shaped and permits a free circular passage, both of the material and of the fluidization agent in the horizontal plane.

Above twist scoops 9 and transition area 10, there are arranged additional twist scoops 11 that can also have a singly or doubly curved surface, although with an entry angle of up to 15° related to the axial flow speed component on their pressure side. Using the same part designations, the discharge angle amounts to up to 90°, whereby the inside diameter of the set of scoops corresponds to the outside diameter of superheater 6.

Above the set of additional twist scoops, there is made a dust arrester 12 whose outside diameter is smaller than the outside diameter of processing space 20 and that is thus smaller than the outside diameter of the container housing 3 in the area of walls 8 and twist scoops 9. The outside diameter of the set of additional twist scoops corresponds to the outside diameter of the dust arrester 12. By adjusting the set of additional twist scoops to the twist scoops 9, one thus gets optimized construction of appliance 1 in terms of pressure loss so that the appliance as a whole can be operated with a high efficiency. Outer contour 3 of container 2 here is cylindrical, at least up to the level of the twist scoops, preferably up to the level of the dust arrester 12 or the additional twist scoops 11, as a result of which, one can prevent a material-intensive construction of container 2 that is preferably made as a pressure reservoir. The set of twist scoops generates and supports via the fluidized-bed layer present in processing space 20 a pretwist or the twist current, as a result of which, the required and desired further transport from the charge cell to the discharge cell is supported. Inside dust arrester 12, there is generated a centrifugal field in which the dust particles and the swept-along particulate materials are moved outside in a circulating fashion and are discharged through an opening.

Above additional twist scoops 11, there are arranged return scoops 13 oriented against the direction of twist, which return scoops deflect the twist of the fluidization agent and convert it into a static pressure in order to recycle the fluidization agent to the superheater 6. The return or recycling twist scoops 13 also have a singly or doubly curved or inclined surface with an entry angle of up to 90° related to the axial flow speed component of the fluidization agent, whereby the discharge angle, assuming the same designation system, amounts to up to 10°. The inside diameter of the set of scoops corresponds to the outside diameter of a discharge pipe 14, while the outside diameter of the set of scoops corresponds to the inside diameter of the superheater 6.

Figure 3:
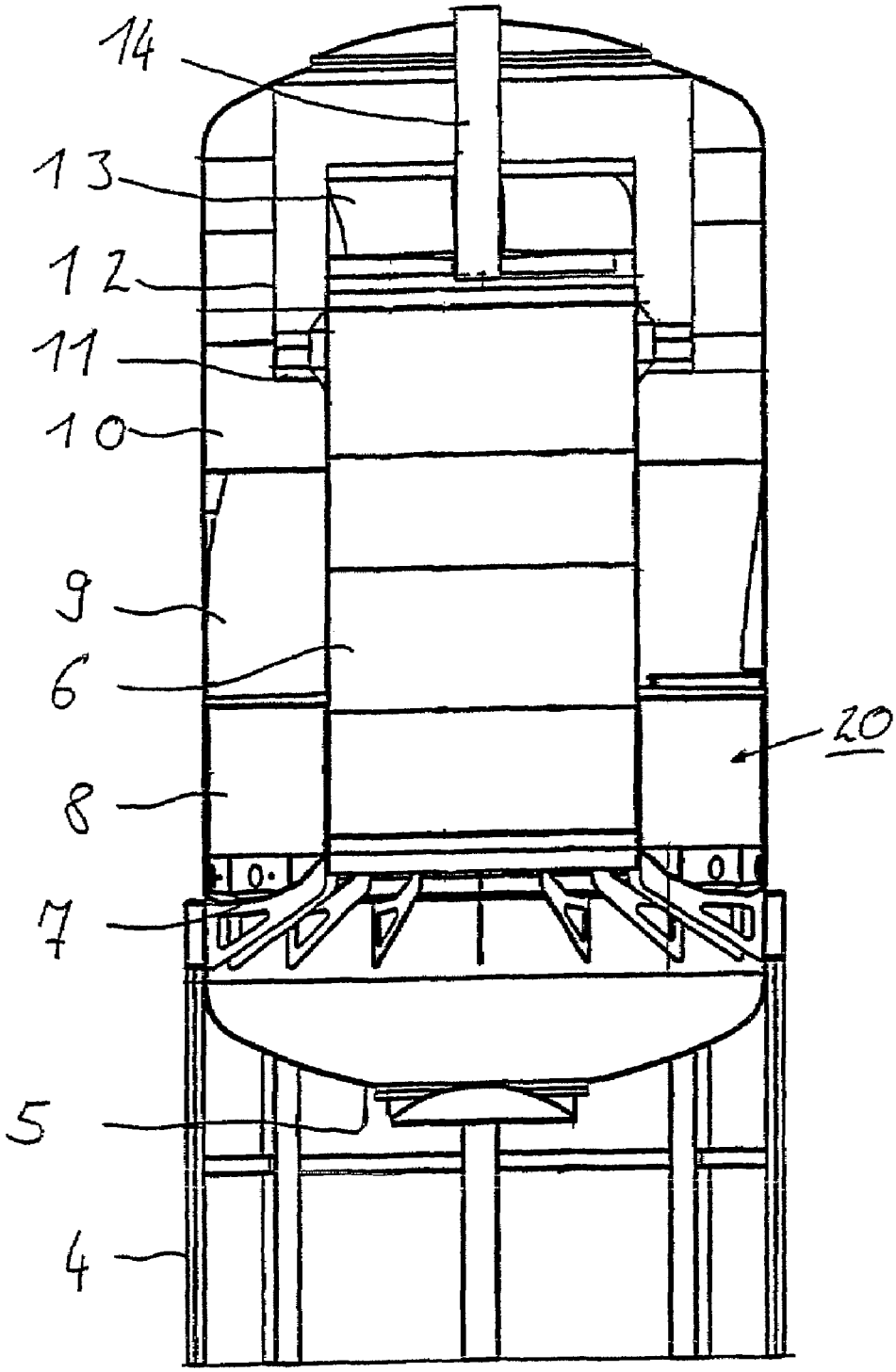
FIG. 3 is a profile view long line A-A in FIG. 2.

FIG. 3 presents a profile view of appliance 1, revealing the structure of the onflow tray 7 and walls 8 that adjoin above. Between walls 8 and the curved or inclined twist scoops 9, a free space is made; but basically, the twist scoops 9 can also adjoin directly on walls 8.

The ring-shaped transition area 10 above twist scoops 9 can be recognized here as can the centrally arranged superheater 6, which extends almost over the entire length of container 2, so that above the onflow tray 7 all the way to the lower edge of twist scoops 9, there will be formed the ring-shaped processing space 20. Dust arrester 12 with the additional twist scoops 11 arranged on the lower end and return scoops 13 for the deflection of the circulating current into an axially aligned current can be recognized here as can the outside dimension of the return scoops 13, which corresponds to the outside diameter of superheater 6 and the arrangement of return scoops 13 around a discharge pipe 14 that is arranged centrally in container 2.

The set of twist scoops replaces the hitherto customary, upwardly widening cone and causes a deflection of the current so that larger particles of the material can be deflected radially outward and can be braked on the container wall and due to the force of gravity can fall down again in order to be exposed to further treatment by the fluidization agent. The transport of the particulate materials from charge cell 15 to discharge cell 17 takes place along the onflow tray 7 in the circumferential direction through the cutouts provided in walls 8 and arranged below. Furthermore, the material to be dried is transported above the twist scoops 9 with the help of the twist current generated by the twist scoops 9 so that one can do without any further assemblies.

The additional twist scoops 11 represent an optimized set of scoops in terms of pressure loss, which set of scoops deflects the fluidization agent into a strengthened twist current in order to be able to separate the material or dust particles that might possibly still be present via a side cyclone. Return scoops 13 essentially have an axial structure and extend radially outward, starting from the discharge pipe 14. That reduces the twist and converts it into static pressure, something that results in easier recycling of the fluidization agent through the superheater 6. The outer container wall 3 can also be adapted to the contour of dust arrester 13, as a result of which, there is a further reduction in the structural space that is needed above the additional twist scoops 11.

Figure 4:
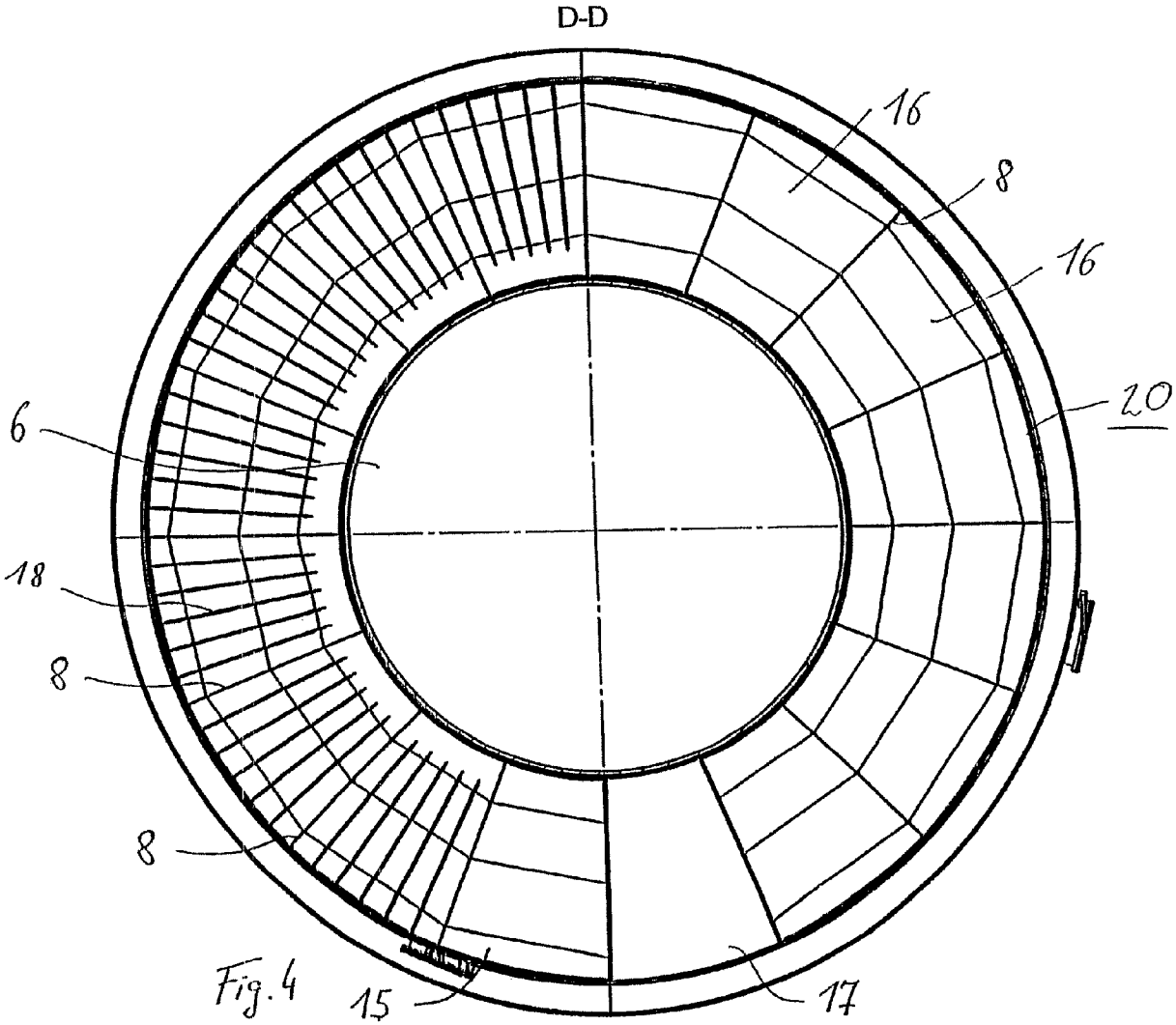
FIG. 4 is a profile view along line D-D in FIG. 2.

FIG. 4 shows a horizontal profile along line D-D in FIG. 2. At the lower end, the drawing shows the charge cell 15 with a charge device, not shown, for example, the screw conveyor, which device is arranged directly next to discharge cell 17, whereby charge cell 15 and discharge cell 17 are so separated from each other in terms of flow technology that a direct transition of the material from charge cell 15 into discharge cell 17 is prevented. Starting from charge cell 15, a plurality of processing cells adjoins, and these cells are separated from each other by partitions 8. Partitions 8 can adjoin directly up against container wall 3 or can be suspended at a certain interval thereof within the ring-shaped processing space 20, which on the underside is limited by onflow tray 7 and on the topside by the underside of twist scoops 9. Intermediate heating walls 18 can be arranged inside processing cells 16 in order to heat the product that is to be processed.

Figure 5:
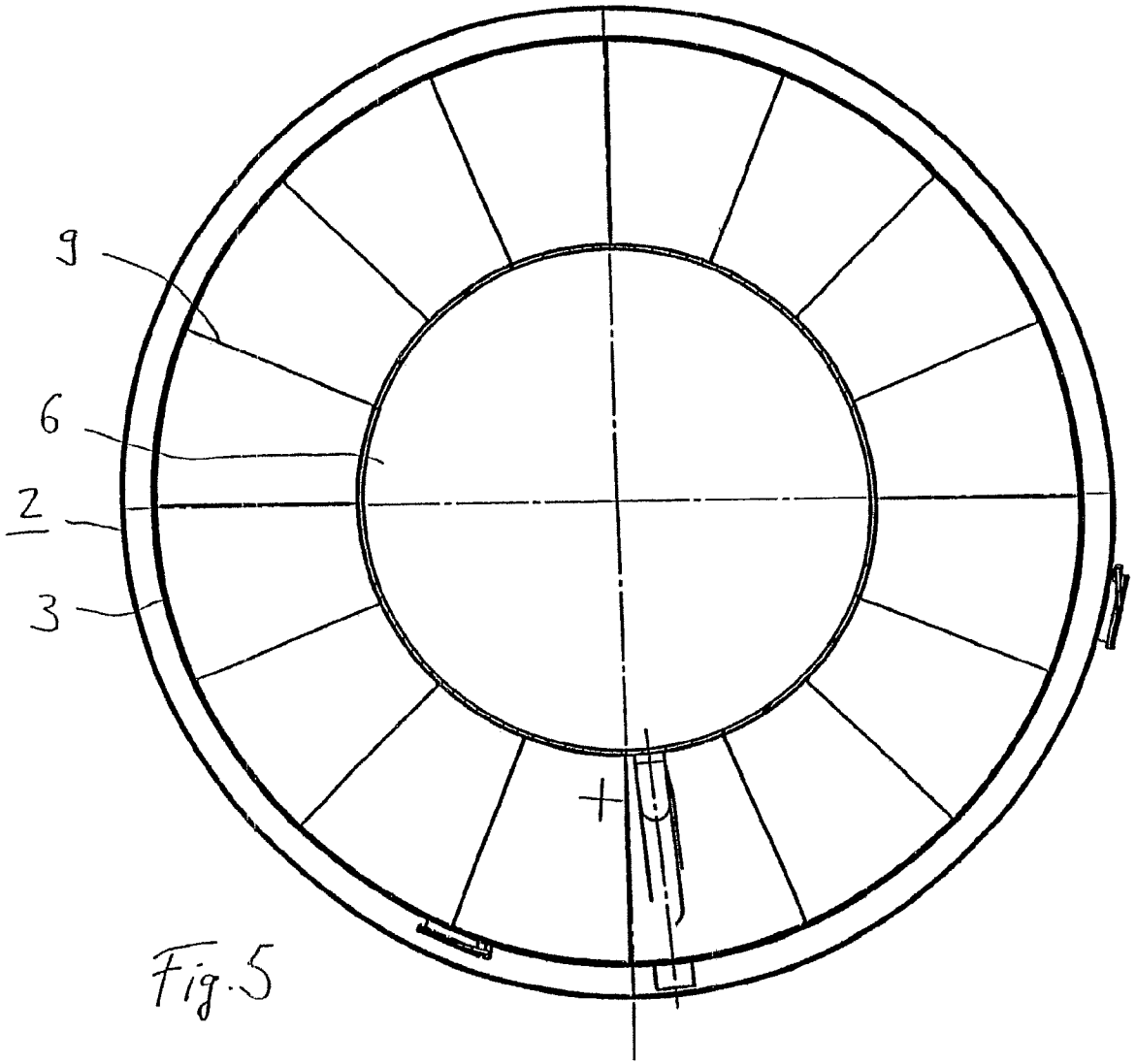
FIG. 5 is a profile view along line C-C in FIG. 2.

FIG. 5 shows a horizontal profile along C-C in FIG. 2, revealing the central arrangement of superheater 6 and twist scoops 9 that are arranged in a ring-shaped pattern around the superheater. Twist scoops 9 constitute the prolongation of the vertical radially extending walls 8 and extend from superheater 6 to outside wall 3 of container 2. Twist scoops 9, just as walls 8, are essentially radially aligned and can display a single or double inclination or curvature in order to deflect the predominantly axial flow or movement of the material to be dried on the basis of the fluidization agent flow that is conveyed from underneath to the top and provide it with a twist.

Figure 6:
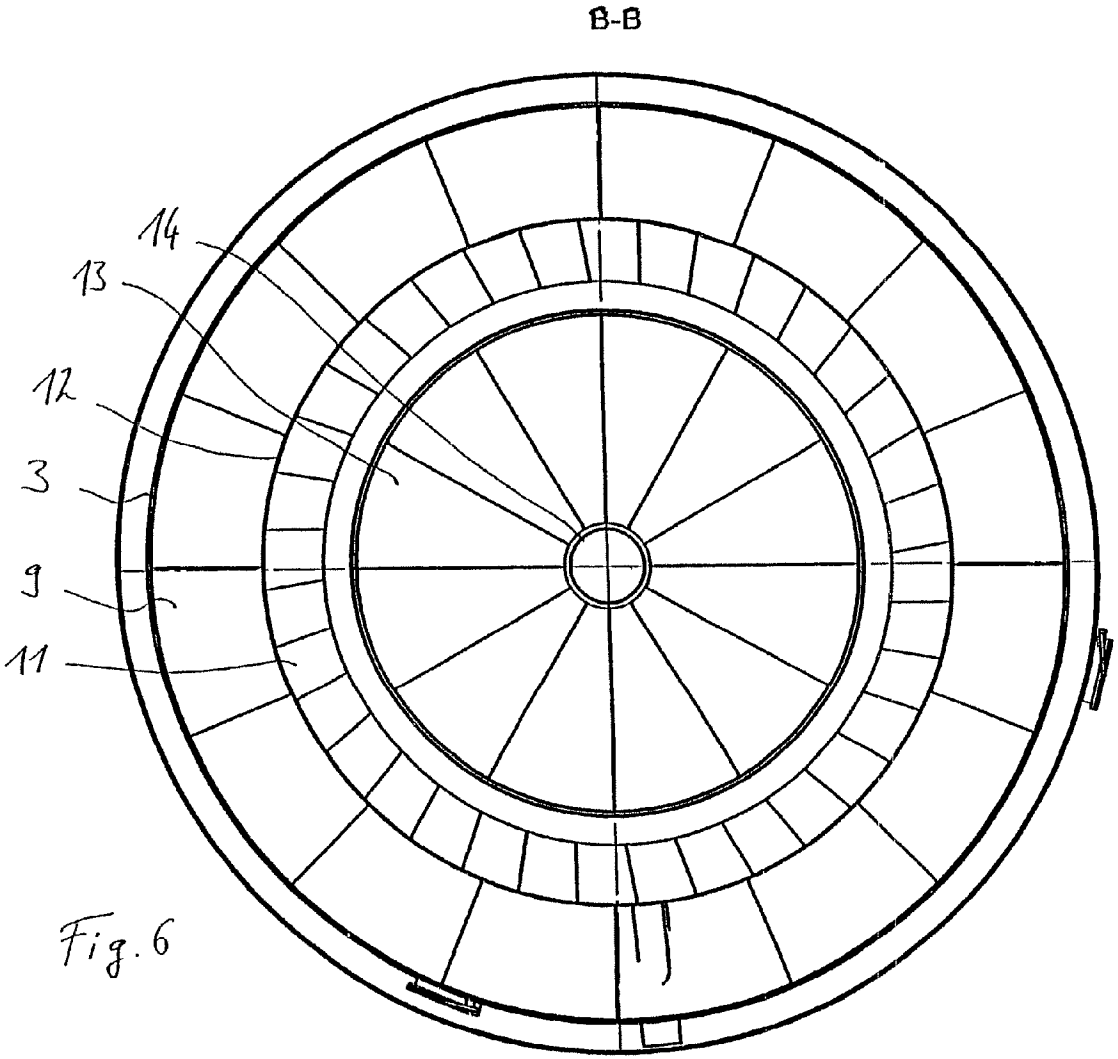
FIG. 6 is a profile view along line B-B in FIG. 2.

FIG. 6 shows a profile in the horizontal plane along line B-B in FIG. 2, revealing the twist scoops 9, the additional twist scoops 11 as well as the essentially cylindrical housing of dust arrester 12. Additional twist scoops 11 also extend essentially radially outward and with their inside rest against the housing of superheater 6; they extend radially outward up to the outer wall of dust arrester 12 and due to their inclinational curvature bring about an increased deflection when compared to the twist scoops 9 and thus cause an increase in the twist. Dust particles can be evacuated out of dust arrester 12, for example, via a side cyclone arranged outside appliance 1, although it is also possible to convey these dust particles into discharge chamber 17.

Above additional twist scoops 11, there are provided return or recycling twist scoops 13 that essentially act in an axial manner and that convert the flow of fluidization agent oriented in the circumferential direction into a static pressure and supply the fluidization agent to the superheater 6 for preparation or heating. A discharge pipe 14 through which the fluidization agent can be evacuated is centrally arranged. The return scoop 13 extends from discharge pipe 14 radially outward up to the circumference of superheater 6. Additional preparation devices for the fluidization agents can be provided in order to condition said agents. In particular, purification devices must be provided so that the fan or the ventilator wheel will not be damaged by any impacting dust particles or the like.

In place of the solution known in the state of the art, that is, the conical widening of a container above the processing chamber or the cells, the invention-based solution makes it possible to give container 2 a cylindrical structure. That results in significant material savings, especially for a container 2 that is to be made as pressure reservoir without any drop in the drying output when the appliance is used as an evaporation dryer. The fan is so designed here that the material to be treated, especially the material that is to be dried, will be fluidized so that the materials or particles to be dried will be transported from charge chamber 15 to discharge chamber 17.

In place of the sixteen cells or chambers shown in the figures with the first charge cell 15, fourteen processing cells 16 and the last discharge cell 17, one can also provide for deviating cell or chamber numbers. A circulating flow pattern offers the advantage that the particles in the fluidization agent are separated in an optimum fashion via the additional twist scoops 11 and the dust arrester 12. The rotation direction of the fluidization agent and the particles in one particular direction likewise facilitates the return and conversion of the twist impulse into a static pressure on the basis of the curvature or inclination of return scoops 13, which have an opposite orientation in relation to the curvature or inclination of the twist scoops and additional scoops 9, 11.

The invention claimed is:

1. Appliance for the removal of fluids and/or solids from a mixture of particulate materials with a container that constitutes a ring-shaped processing space with a cylindrical outer contour with devices for the charging and discharging of the particulate material into and out of the processing space and with a fan device for supplying a fluidization agent from underneath into the processing space as well as devices for the processing of the fluidization agent in the flow direction in front of the fan device, whereby in the processing space, cells are formed extending in the vertical direction through vertically extending walls where one cell constitutes a discharge cell through which there is no or a diminished fluidization agent flow from underneath where at the lower end of the discharge cell the discharge device is arranged and where another cell is provided with a charge device and forms a charge cell and where the cells are open at their upper ends, characterized in that, above the walls (8), there are arranged twist scoops (9), which are inclined or curved in the flow direction from charge cell (15) to discharge cell (17) and where the outside diameter of the twist scoops (9) is not greater than the outside diameter of walls (8) and where twist scoops (9) are surrounded by an outer jacket (3), which cell does not radially protrude outside over the outer jacket (3) that surrounds walls (8).

2. Appliance according to claim 1, characterized in that outer jacket (3) of container (2) above processing space (20) is shaped cylindrically or conically tapering.

3. Appliance according to claim 1, characterized in that the cells (15, 16, 17) are made up of vertical walls (8) upon whose upper end the twist scoops (9) adjoin.

4. Appliance according to claim 3, characterized in that twist scoops (9) are attached to walls (8) or are fashioned together with them.

5. Appliance according to claim 3, characterized in that twist scoops (9) are arranged at a vertical interval to the walls (8) in the container (2).

6. Appliance according to claim 1, characterized in that above the twist scoops (9), there are arranged additional twist scoops (11), which display an identical orientation with respect to the twist scoops (9) or which display a greater inclination or curvature.

7. Appliance according to claim 6, characterized in that the pressure side of the additional twist scoops (11), related to the axial flow speed component of the fluidization agent, is inclined along the lower edge at an angle of up to 15°.

8. Appliance according to claim 6, characterized in that the pressure side of the additional twist scoops (11), related to the axial flow speed component of the fluidization agent, is inclined along the upper edge at an angle of up to 90°.

9. Appliance according to claim 1, characterized in that the pressure side of the twist scoops (9) with relation to the axial flow speed component of the fluidization agent is inclined along the lower edge at an angle of up to 10°.

10. Appliance according to claim 1, characterized in that the pressure side of the twist scoops (9), related to the axial flow speed component of the fluidization agent, is inclined along the upper edge at an angle of up to 35°.

11. Appliance according to claim 1, characterized in that within the appliance, there is arranged a superheater (6) and that the inside diameter of the twist scoops (9) corresponds to the outside diameter of the superheater (6).

12. Appliance according to claim 1, characterized in that above the twist scoops (9), there is made a ring-shaped transition area (10) without any flow influencing devices.

13. Appliance according to claim 1, characterized in that return scoops (13) are provided above the twist scoops (9) with an inclination or curvature that is opposite to the twist scoops (9) whose pressure side, related to the axial flow speed component of the fluidization agent, is inclined at the input end at an angle of up to 90°.

14. Appliance according to claim 13, characterized in that the return scoops (13) with their radial inner end adjoin a centrally arranged discharge pipe (14).

15. Appliance according to claim 13, characterized in that the return scoops (13) have a doubly curved shape.

16. Appliance according to claim 1, characterized in that return scoops (13) are provided above the twist scoops (9) with an inclination or curvature that is opposite to the twist scoops (9) whose pressure side, related to the axial flow speed component of the fluidization agent, is inclined at the output end at an angle of up to 0°.

17. Appliance according to claim 1, characterized in that several intermediate cells (16) are arranged between the charge cell (15) and the discharge cell (17).

18. Appliance according to claim 1, characterized in that the charge cell (15) and the discharge cell (17) are arranged next to each other.

19. Appliance according to claim 1, characterized in that the twist scoops (9) have a doubly curved shape.

20. Appliance according to claim 6, characterized in that the additional twist scoops (11) have a doubly curved shape.

21. Appliance according to claim 1, characterized in that a dust arrester (12) is arranged above the twist scoops (9).

22. Appliance according to claim 1, characterized in that devices for purification, return and heating (6) of the fluidization agent are series connected in front of the fan.

23. Appliance according to claim 1, characterized in that the processing space (20) at its lower end is limited by an onflow tray (7) with throughflow openings.

24. Appliance according to claim 23, characterized in that the onflow tray (7) has an arched or approximately arched contour.

25. Appliance according to claim 23, characterized in that the onflow tray (7) has passage openings for the fluidization agent.

26. Appliance according to claim 25, characterized in that on the radially outer area of the onflow tray (7), the free throughflow surface formed by the passage openings is greater than in the radially inner area.

27. Appliance according to claim 25, characterized in that the free throughflow surface formed by the throughflow openings decreases in the circumferential direction starting from the charge cell (15).

* * * * *